United States Patent [19]

Crum

[11] Patent Number: 4,506,925

[45] Date of Patent: Mar. 26, 1985

[54] FOOTREST MECHANISM FOR A RECLINING CHAIR

[75] Inventor: Michael A. Crum, LaGrange, Ky.

[73] Assignee: Leggett & Platt, Incorporated, Carthage, Mo.

[21] Appl. No.: 455,652

[22] Filed: Jan. 5, 1983

[51] Int. Cl.[3] ..... A47C 1/034

[52] U.S. Cl. ..... 297/69; 297/84; 297/436

[58] Field of Search ..... 297/68, 69, 75, 76, 297/84, 85, 88, DIG. 7, 434, 436

[56] References Cited

U.S. PATENT DOCUMENTS

| | | | |
|---|---|---|---|
| 1,951,793 | 3/1934 | Herman . | |
| 2,781,826 | 2/1957 | Rote | 297/75 |
| 3,128,122 | 4/1964 | Mizelle | 297/68 |
| 3,400,957 | 9/1968 | Rogers, Jr. | 297/75 |
| 3,869,169 | 3/1975 | Johnson . | |
| 4,071,275 | 1/1978 | Rogers, Jr. | 297/85 |
| 4,226,468 | 10/1980 | Johnson | 297/68 X |

*Primary Examiner*—William E. Lyddane

*Assistant Examiner*—Peter R. Brown

*Attorney, Agent, or Firm*—Wood, Herron & Evans

[57] ABSTRACT

An improved footrest extension and retraction mechanism for reclining chairs is disclosed having a footrest which follows the natural movement of an occupant's leg when moving between various chair positions. The footrest mechanism utilizes a pair of spaced substantially parallel glide bars carrying a footrest bracket which are each suspended for arcuate movement by a pair of pivoted suspension links. The glide bars and suspension links are driven in tandem through the use of a handle rotated drive bar extending across the chair frame. Rotation of the drive bar drives pairs of drive and connector links which in turn cause swinging movement of the suspension links and glide bars. A footrest bracket control rod is also disclosed which operates in conjunction with movement of a suspension link to change the orientation of the footrest bracket relative to the glide bars. The linkage arrangement disclosed serves to hold the footrest mechanism in either an extended or retracted position.

13 Claims, 2 Drawing Figures

FOOTREST MECHANISM FOR A RECLINING CHAIR

FIELD OF THE INVENTION

This invention relates generally to chairs, and particularly to reclining chairs having a backrest and a leg or footrest both of which are supported on a base frame and movable relative to the base frame and each other to assume two and three reclining positions, and is specifically related to an improved extension and retraction mechanism for such a footrest.

BACKGROUND OF THE DISCLOSURE

The type of reclining chair to which this invention generally pertains is a three position chair capable of going from a substantially upright and closed position to a first reclining or "TV" position, and then to a fully reclined position. These positions are generally defined by movement of the backrest and an extensible footrest relative to the chair base frame; in some instances, the seat frame is also made movable relative to the chair base. Movement of the reclining chair between its various positions is typically accomplished through force exerted against either the backrest or the arms of the chair by the occupant, thereby causing the backrest to tip backwardly and the footrest to be extended.

It has been very common to use a scissors type or "lazy tong" linkage for the footrest extension mechanism in order to extend the footrest sufficiently forward of the chair. This scissors type linkage has notable disadvantages, foremost among which is the safety problem presented by the scissoring action of the linkage itself, which is capable of causing serious injury, such as to a finger or other extremity caught in the mechanism when it is retracted quickly from its extended position. Additionally, the multiplicity of pivot joints in the scissors linkage are all subject to wear and fatigue, often resulting in a loosening of the mechanism with the consequent failure of the footrest to assume a tightly retracted condition with the chair. Such scissor linkages also have relatively little lateral strength and are subject to easy damage from sideways forces applied to the footrest when extended.

As an alternative to the scissor type footrest extension mechanisms, extension mechanisms have been devised which use longitudinally extending rails which serve to carry the footrest outwardly and upwardly. For example, U.S. Pat. No. 2,936,819 uses rails carrying a footrest support. The rails are slidably mounted in longitudinally slotted brackets attached to the seat and are moved forwardly with respect to the seat as a consequence of relative movement between the seat and a supporting base. U.S. Pat. No. 3,869,169 shows a footrest support which is carried by a pair of parallel rails movable endwise on the chair, which rails are extended and retracted by a handle-driven drive linkage. A linkage is also provided to change the angularity of the footrest relative to the rails.

With specific regard to the mechanism disclosed in the above-identified U.S. Pat. No. 3,869,169, the system provides for movement of the rails through the use of rollers on which the rails or "glide bars" roll. In actual use, this causes the top edge of the footrest to "hang" on the front of the cushion of the seat when trying to open the chair. Due to the fact that the footrest advances relatively straight out on these rollers, the footrest mechanism also has an unnatural movement to the TV position. More specifically, the occupant of the chair is first hit behind the knees by the advancing footrest, with the footrest thereupon sliding down the length of the occupants leg. The same undesirable mction likewise occurs in reverse when retracting the footrest. This relative endwise movement of the glide bars further renders retraction of the footrest difficult due to the fact that the natural motion for a person in a chair is to push downward on the footrest to close it; more horizontal leg motion is therefore required of the occupant because of the relatively straight line operation of the '169 mechanism. This can result in use of excessive downward pressure placed on the footrest mechanism, which will bend it. Also, use of rollers in the footrest extension mechanism creates a need for relatively close tolerance levels in production and manufacture of the mechanism, with a consequent increase in loose and unacceptable chairs reaching retail stores.

SUMMARY OF THE INVENTION

It is a general object of this invention to provide a reclining chair which is capable of movement through plural reclining positions to thereby support the body of an occupant in a relaxed and comfortable position. A concomitant object is to provide an improved footrest mechanism for such a reclining chair.

More specifically, it is an object of the present invention to provide an improved footrest extension and retraction mechanism for a reclining chair wherein a pair of side rails or glide bars located on opposite sides of the chair are moved in an arcuate path relative to the chair seat frame upon the driving of the glide bars forwardly, the glide bars each being suspended for swinging movement by a pair of suspension links.

Yet another object of the present invention is to provide a footrest mechanism having arcuately swinging glide bars and suspension links in a form which reduces the vertical clearance necessary for operation of the mechanism.

It is yet another object of this invention to provide the above footrest extension and retraction mechanism with a footrest bracket control rod to properly orient the footrest during movement of the glide bars.

It is a further object of the invention in one preferred embodiment to drive the glide bars through the use of a torsion-like bar and drive linkages, the drive being handle operated.

These general objects of the invention, as well as other objects and advantages, are accomplished in the improved footrest extension and retraction mechanism of the present invention wherein a pair of spaced substantially parallel footrest glide bars are located one on each side of a seat frame, the glide bars supporting at their forward ends a footrest bracket pivotally mounted thereto and extending therebetween. A pair of suspension links are provided for each glide bar, each pair of suspension links being laterally spaced along one side of the seat frame, and comprising a forward and a rearward suspension link. The upper end of each suspension link is pivotally connected to a portion of the seat frame, with the lower end pivotally connected to a portion of a respective glide bar. The glide bars are thus mounted for swinging motion along an arcuate path either forwardly or rearwardly to thereby move the footrest bracket between extended and retracted positions.

In a preferred form, the glide bars are driven in tandem through the use of a torsion-like drive bar which is rotatably carried on the seat frame. The drive bar extends between the sides of the frame, and is rotated by a manually graspable handle which is fixed to the drive bar. Rotary motion of the drive bar is transmitted through like pairs of drive and connector links located on each side of the chair and which interconnect the drive bar and the glide bars. The drive links are each fixed at one end to the drive bar and are pivotally connected at the other end to a connector link, which in turn is pivotally connected to the lower end of a rearward suspension link.

The improved footrest mechanism further includes a footrest pivoting mechanism to change the orientation of the footrest bracket relative to the glide bars from a retracted position wherein the footrest supporting surface is facing generally outwardly, to an extended position wherein the footrest supporting surface is facing generally upwardly. To this end, the invention uses a rigid footrest bracket control rod extending generally along the inboard side of a glide bar. The control rod is pivotally connected at one end to a rearward suspension link and at the other end to the upper portion of the footrest bracket. The control rod is so sized and shaped that the arcuate motion of the rearward suspension link operates the control rod to effect pivoting of the footrest bracket.

The improved footrest mechanism of this invention further provides for the arrangement of the drive, connector and suspension links such that the drive links and connector links are maintained in a first and rearward over-center position relative to the pivot point of the connector link on the rearward suspension link to thereby hold the chair in a retracted position, and in a second and forward under-center stopped position to thereby hold the chair in a footrest bracket extended position. Biasing means in the form of a spring is additionally provided for holding the footrest bracket in either of the desired positions.

In operation, rotation of the handle and connected drive bar effects arcuate swinging motion of the drive linkage system, thereby causing the suspension links and the attached glide bars to likewise move in an arcuate path either forwardly and outwardly or rearwardly, depending upon the direction of movement of the handle. As the glide bars are pivoted forwardly and outwardly, the footrest control rod moves rearwardly relative to the glide bar so as to cause the footrest bracket to move from a vertical attitude to a horizontal one.

The foregoing improved footrest extension and retraction mechanism provides for proper clearance for the footrest under the seat cushion, and for easy opening of the chair. It also imitates the normal movement of the human leg in that, as the footrest progresses outwardly, it makes a single contact with the occupant's leg and then lifts the leg in a normal upward arc. This motion consequently makes the mechanism easy to retract to thereby close the chair.

Close tolerance requirements in the mechanism are also substantially eliminated due to the use of pivoting links rather than rollers. Moreover, a minimum number of pivot points are used, reducing the chances of wear and fatigue failures. The instant mechanism is also extremely safe, having no exposed parts which can cause injury, and is relatively sturdy against lateral forces.

Further, the footrest extension mechanism particularly described herein operates independently of the position or movement of the chair backrest or seat. That is, the extension mechanism operates from significant pivots only on the seat frame, thereby providing for movement of the mechanism as a whole along with the seat frame. Consequently, neither relative movement of the backrest or of the seat frame itself affects operation of the footrest mechanism, the latter being solely controlled through operation of the handle-driven linkage system. The mechanism is of course adaptable to other driving means and methods of actuation.

The foregoing as well as other objectives, features and advantages of the present invention will be more readily understood upon consideration of the following detailed description of the invention taken in conjunction with the accompanying drawings, in which:

DETAILED DESCRIPTION OF A PREFERRED EMBODIMENT

Figures 1, 2:
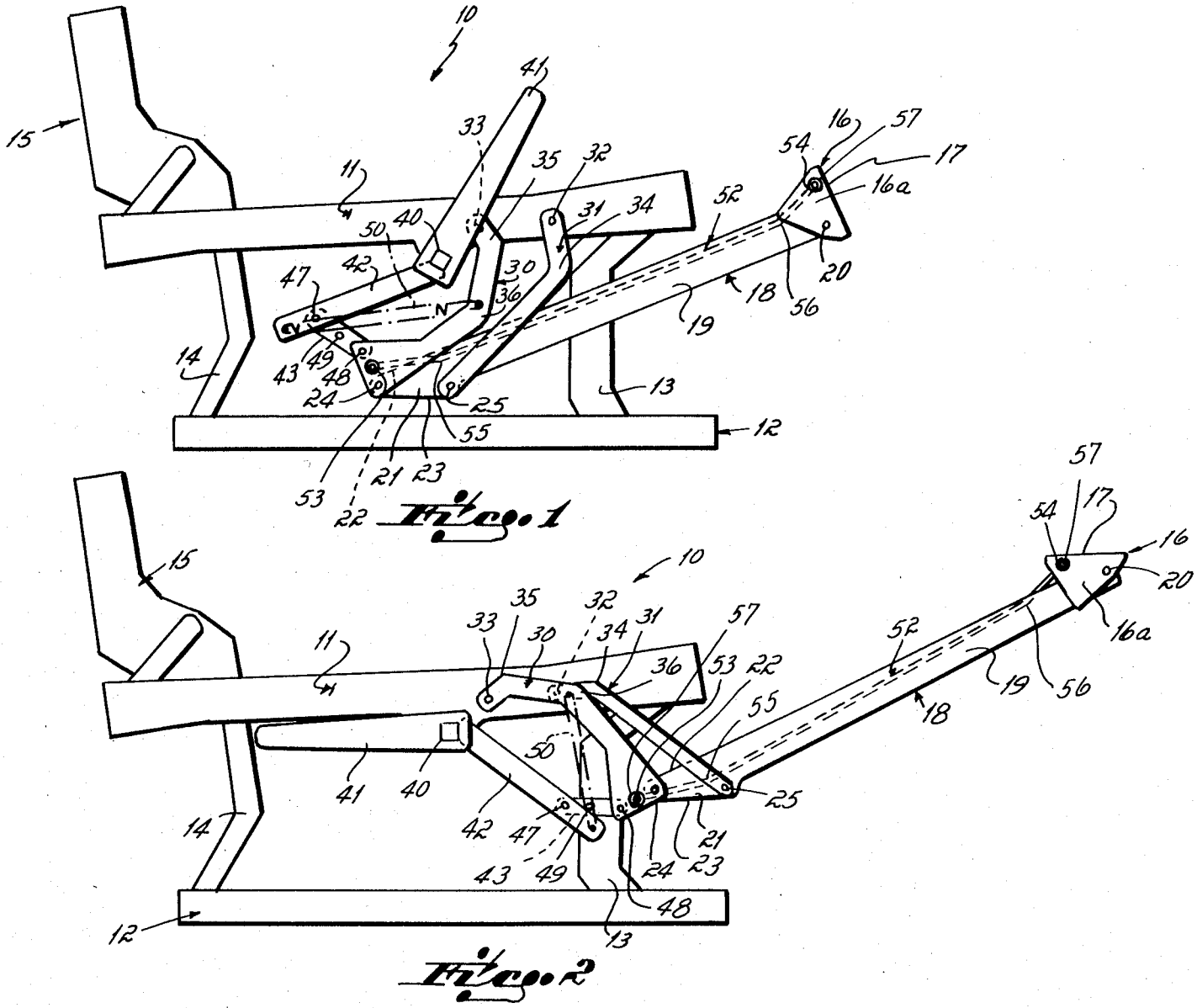
FIG. 1 is an elevational view of a footrest extension mechanism made in accordance with the principles of this invention mounted on a chair base frame, the mechanism being in a closed or retracted position.
FIG. 2 is similar to FIG. 1, with the mechanism open or extended, the chair being in the TV position.

Referring now to FIG. 1, a base frame for a conventional reclining chair is indicated generally at 10. The type of reclining chair to which the improved footrest extension mechanism of this invention is particularly adapted is of the type capable of movement from a closed position to an intermediate or TV position (FIG. 2) and thence to a fully reclined position with the backrest of the chair tilted rearwardly. The base frame 10 includes an upper seat frame generally indicated at 11, a base platform 12 and forward and rearward pairs of support legs 13 and 14 respectively, which support the seat frame 11 on the platform 12. The legs 13 and 14 and the seat frame 11 and platform 12 may conveniently be made of suitable structural materials, ordinarily being made of metal. For purposes of illustration herein and to simplify the description of the footrest mechanism of this invention, only one side of the footrest mechanism and the chair in general is described. It will be understood that equivalent described parts associated in a substantially identical manner are located on the other side of the chair, unless specifically noted otherwise.

The major structural moving parts of the chair frame include a backrest 15, the noted seat frame 11, and a leg or footrest bracket 16. Each of these major structural moving parts may be of any desired type of standard construction, and will ordinarily be upholstered with an appropriate covering. The relative movement and means for effecting the movement of the backrest 15 and/or the seat carried on the seat frame 11 is incidental to the disclosure herein, and consequently will not be described in any detail. It will be recognized that although the embodiment of the invention specifically described herein functions independently of the means effecting movement of the backrest and/or seat to the various reclining positions of the chair, this footrest mechanism is adaptable to other modes of actuation and operation which may involve such movement of the backrest and/or seat.

The footrest bracket 16 has a planar face 17 to which a footrest or ottoman is mounted or formed thereon. The footrest bracket 16 is carried by a pair of rails or glide bars 18, one of which is located on each side of the chair base frame 10. The glide bars 18 each have an elongate generally straight forwardly extending portion 19 which terminates in a forward end to which the footrest bracket 16 is pivotally mounted, as by the footrest pivot pin 20 which extends transversely through a side flange 16*a* of the footrest bracket and the glide bar 18.

The glide bar 18 has a rearward portion 21. The rearward portion 21 has an upper edge 22 which is generally an extension of the upper edge of the elongate forward portion 19, and a lower edge 23 angled from the upper edge 22. The lower edge 23 extends below the plane of the lower edge of the forward portion 19 of the glide bar a small distance before angling back up to such lower edge. This form for the rearward portion 21 provides a satisfactory surface for the formation of laterally spaced pivot points through which pivot pins 24 and 25 extend and from which the glide bars 18 are suspended for arcuate motion. As will be seen, the pivots 24 and 25 are so arranged that the glide bar rearward portion's lower edge 23 is generally parallel to the platform 12, with the elongate forward portion 19 of the glide bar 18 angled upwardly. It will be obviously recognized that the angularity of the forward portion of the glide bar 18 can be designed as required in manufacture to promote a tight fit of the footrest with the chair in a retracted or closed position.

The glide bars 18 are supported from the pivots 24 and 25 by rearward and forward suspension links 30 and 31, respectively. Forward suspension link 31 is pivotally connected to the rearward portion 21 of the glide bar at pivot 25, and is pivotally connected to the outboard side of the seat frame 11 by pivot pin 32. Rearward suspension link 30 is pivotally connected to the rearward portion 21 at pivot 24, and is pivotally connected to the same outboard side of the seat frame 11 by pivot pin 33. The pivotal connections 32 and 33 for the suspension links are laterally spaced apart along the seat frame 11 a distance approximately equal to the lateral spacing of the pivotal connections 24 and 25. In this embodiment of the invention, the upper pivots 32 and 33 are generally located in the same horizontal plane; the lower pivots 24 and 25 are likewise located in another horizontal plane. For reasons to be made more apparent in the disclosure to follow, the pivot 32 of the suspension link 31 is set slightly forwardly of the lower pivot 25. In a like manner, pivot 33 of the rearward suspension link 30 is also set forwardly of the lower pivot 24.

Forward suspension link 31 is provided with a forwardly extending elbow 34 which yields a center line for the suspension link, as viewed from the lower end of the link, that is first upward and forward then upward and rearward. Rearward suspension link 30 is provided with a similar upper elbow 35 and with an additional middle elbow 36 thus defining a center line for the rearward suspension link which is roughly arcuate.

Suspension links bent in the manner described and arranged on pivots as noted serve to maintain the position of the footrest bracket 16 at a single point on the back of the occupant's leg when the footrest extension mechanism is operated. As is immediately obvious, straight links employed with the pivots arranged as shown and described herein would serve to initially move the footrest bracket 16 downwardly relative to the leg and then upwardly as the glide bars 18 move forward. Straight links would also require much greater vertical clearance in which to operate. Suspension links designed in the manner of this invention thus serve to reduce the vertical distance necessary for the proper clearance of the glide bars and extension mechanism, in general permitting the use of this extension mechanism in chairs of relatively small height.

In this embodiment of the invention, arcuate motion for the glide bars 18 and the suspension linkage system is provided by a drive system which includes a torsion-like drive bar 40, an actuating lever 41 in the form of a handle and driving linkages on each side of the chair comprising a drive link 42 and a connector link 43. The square tube drive bar 40 extends between the sides of the seat frame 11 substantially transversely therebetween, and is rotatably carried by the seat frame in a conventional manner well known in the art.

The drive bar 40 is driven or rotated by a lever action provided by the handle 41 which is fixed in a conventional manner at one end of the drive bar, typically the right-hand side of the drive bar, and spaced a slight distance outwardly from the outboard side of the seat frame 11. It has been found advantageous herein to mount the drive bar 40 at a point below the seat frame 11 to thereby permit the handle to be rotated completely below the level of the seat and into a position where there is less chance of interference with the normal arm movement of an occupant of the chair.

Drive links 42 are respectively fixed at one end adjacent the ends of the drive bar 40, as by welding. The drive links are here affixed along a lower edge of the square tubing forming the drive bar, and serve in effect as lever arms from the handle 40. The drive links 42 extend substantially rearwardly from the drive bar 40, also depending slightly downwardly. The action of the drive links 42 is transmitted to the glide bars 18 via the use of a short connecting link 43 which pivotally interconnects the lower ends of the respective drive links 42 with the respective rearward suspension links 30. The connector links have an upper pivot connection 47 with a drive link 42 and a lower pivot connection 48 with a rearward suspension link 30. In the chair closed position (FIG. 1) the pivot of the connector link 43 on the rearward suspension link 30 is at a point upward and rearward of the pivot connection 24 of the rearward suspension link 30 with the glide bar 18.

A stop 49 is formed on the outboard side of the connector link 43 spaced inwardly from one end of the link a small distance; the function of the stop 49 will be described in more detail hereafter.

Emphasis has been placed herein on the relative orientation of the various links and pivots due to the ability of this improved footrest extension mechanism to releasably hold the footrest bracket in a retracted position or in an extended position by virtue of this linkage arrangement. In the closed position of the chair, as illustrated in FIG. 1, the drive link 42 and connecting link 43 are maintained in a first and rearward over-center position relative to the pivot 48 of the connector link 43 with the rearward suspension link 30. This position has a natural tendency to maintain the footrest bracket 16 and glide bars 18 in a closed condition, which is further facilitated by the natural rest position of the mechanism with the footrest retracted. Advancing the actuating lever or handle 41 through to the footrest extended position (approximately 135°) advances the drive links 42 through a like arc, as shown in FIG. 2. The lever action of the drive links 42 is transmitted to the suspension links and glide bars through the connector links 43, which drive forwardly as the drive links 42 advance, and which pivot about pivot points 47 in a clockwise manner.

Upon full extension of the footrest, a second and under-center condition for the linkages is achieved which serves to releasably hold the extended footrest and glide bars in the extended condition. More specifically, the pivots 47 and 48 are now below the pivot 24, with further movement of a connector link 43 in a clockwise manner prevented by the stop 49, which engages the side edge of the respective drive link 42. The footrest extension mechanism is thus releasably maintained in the extended condition. The additional weight of the occupant's legs upon the footrest further serves to promote the stability of the mechanism in this extended condition.

A biasing member in the form of a spring 50 may be additionally provided to maintain the drive linkage system in the first as well as the second conditions. In practice, it has been found that the mechanism performs quite satisfactorily with or without the spring 50. As shown, the spring extends between a connection at one end adjacent the elbow 36 of the rearward suspension link 30 and a connection at the other end adjacent the end of the drive link 42 and below the pivot connection 47.

The arrangement of the various linkages is designed so that it is only necessary to exert a minimal force on the handle 41 in order to extend the footrest to a fully opened position; conversely, only a small downward pressure on the footrest to overcome the noted under-center condition serves to place the footrest in a retracted or closed condition.

As the glide bars 18 and the attached footrest bracket 16 are moved between extended and retracted positions, it is necessary to change the angularity of the face 17 of the footrest bracket from a substantially vertical outwardly facing orientation with the footrest extension and retraction mechanism retracted to a substantially horizontal upwardly facing orientation when extended. This is accomplished herein through the use of a single control rod 52 which extends between pivots 53 and 54. The bracket control rod 52 in this preferred embodiment is a ¼" steel rod which has been bent at a point 55 spaced inwardly along the rod from the pivot 53 on the rearward suspension link 30, with a similar bend 56 provided at a point spaced inwardly along the rod from the pivot connection 54 on the upward end of the footrest bracket side flange **16*a*. The control rod 52 is mounted on the inboard side of one of the glide bars 18 by bending the ends of the rod to a 90° angle and inserting the bent ends through holes provided in the rearward suspension link 30 and in the bracket side flange 16*a* thereby forming the pivot points 53 and 54, respectively. Locking caps 57 are then applied to the portions of the control rod which extend through the rearward suspension link 30 and the side flange 16*a*** of the footrest bracket to thereby pivotally fix the rod ends into position.

The control rod 52 operates in conjunction with movement of the rearward suspension link 30 to effect the change in orientation of the face 17 of the footrest bracket. For example, as the rearward suspension link 30 swings forwardly, the rearward pivot 53 of the control rod is caused to progress in a counterclockwise fashion about the pivot connection 24. This motion pulls the control rod 52 relatively rearwardly, which in turn causes the footrest bracket 16 to pivot in a counterclockwise direction about the footrest pivot 20. The orientation of the face 17 of the footrest bracket is consequently changed in a simple and expedient manner from a general vertical orientation with the chair closed to a substantially horizontal orientation with the footrest fully extended.

In operation, the glide bars 18 supported by the suspension links 30 and 31 are caused to move through an arcuate path through the driving force supplied by the handle actuated drive bar 40 and transmitted through drive links 42 and connector links 43. The arrangement of the various links is such that linkage positions are achieved holding the footrest extension mechanism in either the retracted or extended condition. Operating in conjunction with the movement of a rearward suspension link 30 is the footrest control rod 52 which causes the pivoted footrest bracket 16 to change angularity in response to the arcuate motion of the rearward suspension link.

The improved footrest extension and retraction mechanism described herein provides a mechanism which is easy to operate and extremely safe. The mechanism provides the desired feature of following the upward movement of the chair occupant's leg and does not travel along the back of the leg when the footrest is being extended or retracted. The improved mechanism is formed of a minimal number of parts which do not require high tolerance construction, thus facilitating manufacture as well as promoting long and satisfactory performance of the mechanism. The improved footrest mechanism advantageously combines a suspension linkage system for arcuately swinging glide bars which has a relatively small vertical clearance requirement with a footrest bracket control rod operated by such swinging motion for changing the angularity of the footrest.

While the invention has been described in connection with a certain presently preferred embodiment, it will be immediately obvious to those skilled in the art many modification of structure, arrangement, portions, elements, materials, and components used in the practice of the invention which are particularly adapted for specific situations without departing from the principals of this invention.

What is claimed is:

1. An improved footrest extension and retraction mechanism for a reclining chair, the chair having a back movable to plural positions of varying angularity, and a seat frame with opposed sides and a forward end and a rearward end, comprising:

a pair of spaced substantial parallel footrest glide bars located beneath the seat frame, a glide bar being located on each side of the seat frame, the glide bars each having a rearward end and a forward end, a footrest bracket pivotally mounted to the forward ends of the glide bars and extending therebetween, the footrest bracket having a footrest support face, a pair of suspension links for each glide bar, each pair of suspension links being laterally spaced along one side of the seat frame and comprising a forward and a rearward suspension link, the suspension links having an upper end and a lower end, the upper end of each suspension link being pivotally connected to a portion of the seat frame, the lower end of each suspension link being pivotally connected by a pivot connection to a portion of a respective glide bar, drive means operatively interconnected between said seat frame and said glide bars for driving the glide bars in tandem in a forwardly and upwardly arcuate motion, a footrest pivoting mechanism to change the orientation of the footrest bracket relative to the glide bars between a footrest bracket retracted position wherein the footrest supporting surface is substantially vertical, to an extended position wherein the footrest supporting surface is substantially horizontal, the footrest pivoting mechanism comprising a rigid footrest bracket control rod extending generally along the side of a glide bar, one end of said control rod being pivotally connected to said footrest bracket, the opposite end of the control rod being pivotally connected to the lower end of one of said suspension links by a pivot connection spaced from the pivot connection between said one of said suspension links and said glide bar such that pivoting movement of said one of said suspension links relative to said seat frame results in a change of orientation of the footrest bracket relative to the glide bars.

2. The improved footrest extension and retraction mechanism of claim 1 wherein the glide bars have a rearward portion and an elongate upwardly extending forward portion, the lower portions of the pair of suspension links for each glide bar being pivotally connected to the rearward portion of the respective glide bar.

3. The improved footrest extension and retraction mechanism of claim 2 wherein said drive means for driving the glide bars further includes a drive bar rotatably carried on the seat frame and extending between the sides thereof, a pair of drive links, the drive links each being fixed at an upper end to the drive bar at opposite sides thereof, the drive links each being located rearwardly of the rearward suspension links, and a pair of connector links, a connector link extending between each drive link and a respective rearward suspension link, each connector link being pivotally connected at one end to the lower end of a drive link and at the opposite end to the lower end of a rearward suspension link.

4. The improved footrest extension and retraction mechanism of claim 3 which further includes a stop on at least one of said connector links, wherein the drive links, connector links and suspension links being so arranged that in the footrest bracket retracted position the drive links and connector links are maintained in a first and rearward position above the pivotal connection of the connector link to the rearward suspension link, and in a second forward position with the footrest bracket in an extended position, said stop on said connector link engaging a side edge of one of said drive links in said second position of said drive links and connector links.

5. The improved footrest extension and retraction mechanism of claim 4 wherein each rearward suspension link has an upper portion extending downwardly and forwardly, an intermediate portion extending generally downwardly, the lower portion extending rearwardly and downwardly, the lower portion terminating in an enlarged end, the rearward suspension link being pivotally fixed at a lower point on the lower portion to the respective glide bars rearward portion, and pivotally fixed at an upper point on the lower portion to a connector link, the pivot point for the connector link and the rearward suspension link being located above and rearwardly relative to the lower pivot point of the glide bar and rearward suspension link, and wherein the pivot for the connector link on the drive link is located in a first position above and rearwardly of the pivot point for the connector link and the suspension link with the footrest in the retracted position, such that axial rotation of the drive bar to extend the footrest causes the drive link to move forwardly and downwardly thereby causing the connecting link to move downwardly and forwardly, the connecting link being rotated clockwise around its drive link pivot to a second lower position rearwardly of the pivot point for the connector link and the suspension link upon full extension of the footrest, said stop on the connecting link in said second position preventing further clockwise rotation through engagement with the side of a drive link.

6. The improved footrest extension and retraction mechanism of claim 1 wherein said opposite end of the control rod is pivotally connected to the lower end of said one of said suspension links above the pivot connection of said one of said suspension links and the glide bar.

7. The improved footrest extension and retraction mechanism of claim 3 further including a manually graspable handle fixed to the drive bar to effect axial rotation of the drive bar, and wherein the means for driving the glide bar operates independently of the movement of the chair back or seat frame.

8. An improved footrest extension and retraction mechanism for a reclining chair, the chair having a seat frame supported therein, comprising:

a pair of spaced footrest glide bars, one glide bar located on each side of the frame, a footrest bracket extending between the glide bars at the forward ends thereof, the footrest bracket being pivotally connected at opposite ends to the glide bars, the footrest bracket having a footrest support face, a pair of suspension links for each glide bar, each pair of suspension links being laterally spaced along one side of the seat frame, and comprising a forward and rearward suspension link, the suspension links having their upper ends pivoted to a portion of the seat frame, the suspension links having their lower ends pivoted to a portion of the glide bar, means for driving the glide bars in tandem in an arcuate motion, the driving means comprising a drive bar rotatably carried by the frame and extending between the sides thereof, a handle fixed to the drive bar to effect axial rotation of the drive bar, a pair of drive links, the drive links each being fixed at one end to the drive bar at opposite ends thereof, the drive links being located rearwardly and upwardly relative to the rearward suspension link, a pair of connector links, each connector link being pivotally fixed to a respective drive link and rearward suspension link, and a footrest pivoting mechanism to alter the angular position of the footrest bracket relative to the glide bars between a first and retracted position wherein the footrest supporting surface faces generally forwardly, to an extended position wherein the footrest supporting surface faces generally upwardly, the footrest pivoting mechanism comprising a footrest bracket control rod extending between one of the rearward suspension links and the footrest bracket, the control rod being pivotally connected by a first fixed pivot to said one of the rearward suspension links and by a second fixed pivot to said footrest bracket such that pivotal movement of said one of the rearward suspension links relative to said seat frame results in a change of position of the footrest bracket relative to the glide bars.

9. An improved footrest extension and retraction mechanism for a reclining chair comprising:

a seat frame, a pair of generally parallel footrest glide bars located beneath the seat frame, a glide bar being located on each side of the chair, each glide bar having a forward and rearward end, a footrest bracket pivotally mounted to the forward ends of each of the glide bars, the footrest bracket having a footrest support face, a pair of suspension links connecting each glide bar to the seat frame for arcuately swinging movement relative to the seat frame, drive means for driving the glide bars and suspension links in arcuately swinging movement, and a footrest pivoting mechanism to change the orientation of the footrest bracket relative to the glide bars between a footrest bracket retracted position wherein the footrest support face is substantially vertical to an extended position wherein the footrest support face is substantially horizontal, said footrest pivoting mechanism comprises a rigid footrest bracket control rod which extends generally along the side of a glide bar, the control rod being carried by a first pivot on one of said suspension links and by a second pivot on the footrest bracket such that arcuately swinging movement of said one of said suspension links relative to said seat frame results in a change of orientation of said footrest bracket relative to said glide bars.

10. The improved footrest extension and retraction mechanism of claim 9 wherein each pair of suspension links are laterally spaced along one side of the chair, each pair comprising a forward and a rearward suspension link, each link being pivotally connected at one end to a portion of said seat frame and at the other end to a portion of a respective glide bar, and wherein the footrest bracket control rod is pivotally carried at one end by a rearward suspension link and at a point above the pivot connection between said rearward suspension link and the glide bar.

11. The improved footrest extension and retraction mechanism of claim 10 wherein the glide bars have a rearward portion and an elongate upwardly extending forward portion, the suspension links for each glide bar being pivotally connected to the rearward portion of the respective glide bar.

12. The improved footrest extension and retraction mechanism of claim 11 the means for driving the glide bars further includes an axially rotatable drive bar, a pair of drive links, the drive links each being operatively connected at an upper end to the drive bar at opposite sides thereof, and a pair of connector links, a connector link extending between each drive link and a respective rearward suspension link, each connector link being pivotally connected adjacent the lower end of a drive link and to the lower end of a rearward suspension link at a point above the pivot of such suspension link on the glide bar, and a stop on each connector link.

13. The improved footrest extension and retraction mechanism of claim 9 wherein the drive, connector and suspension links are so arranged that in the footrest bracket retracted position the drive link and connector link are maintained in a first position relative to the pivot point of the connector link on the rearward suspension link, and in a second position relative to the pivot point of the connector link on the rearward suspension link with the footrest bracket in an extended position, the stops on the connector links engaging a side edge of a respective drive link in said second position.

* * * * *